United States Patent [19]

Davis

[11] 4,177,768

[45] Dec. 11, 1979

[54] FUEL COMPOSITIONS

[75] Inventor: Bryan T. Davis, West Bloomfield, Mich.

[73] Assignee: Ethyl Corporation, Richmond, Va.

[21] Appl. No.: 4,716

[22] Filed: Jan. 19, 1979

[51] Int. Cl.[2] ..... C10L 1/18

[52] U.S. Cl. ..... 123/1 A; 44/53; 44/57; 44/66; 44/70; 44/76; 44/DIG. 4; 123/198 A

[58] Field of Search ..... 44/57, 53, 70, 76, DIG. 4, 44/66, 77; 123/1 A, 198 A

[56] References Cited

U.S. PATENT DOCUMENTS

| | | | |
|---|---|---|---|
| 2,315,072 | 3/1943 | Nelson et al. | 252/48 |
| 2,631,979 | 3/1953 | McDermott | 252/57 |
| 2,632,695 | 3/1953 | Landis et al. | 44/66 |
| 2,822,330 | 2/1958 | Riggs, Jr. et al. | 252/8.55 |
| 2,861,874 | 11/1958 | O'Kelly et al. | 44/66 |
| 3,017,354 | 1/1962 | Riggs, Jr. | 252/8.55 |
| 3,304,162 | 2/1967 | Marvel, Jr. | 44/66 |
| 3,694,357 | 9/1972 | Zaweski | 252/48.2 |
| 3,696,048 | 10/1972 | Hausler et al. | 252/392 |
| 3,834,882 | 9/1974 | Garth | 44/66 |
| 4,002,437 | 1/1977 | Broeckx et al. | 44/66 |

OTHER PUBLICATIONS

Brazilian Patent Application No. P17700392.

*Primary Examiner*—Winston A. Douglas
*Assistant Examiner*—J. V. Howard
*Attorney, Agent, or Firm*—Donald L. Johnson; Robert A. Linn; Willard G. Montgomery

[57] ABSTRACT

An anti-wear compression ignition fuel for use in diesel engines comprising (1) a monohydroxy alkanol having from 1 to 5 carbon atoms, (2) an ignition accelerator and (3) a wear inhibiting amount of a dimerized unsaturated fatty acid and an ester of a phosphorus acid.

39 Claims, No Drawings

FUEL COMPOSITIONS

BACKGROUND OF THE INVENTION

It has recently been disclosed in Brazilian patent application No. P17700392 that alcohols, such as methanol and ethanol, can be substituted for conventional petroleum derived diesel fuels for burning in diesel engines, when used in combination with an ignition accelerator, such as ethyl nitrate or nitrite. Reportedly, the addition of alkyl nitrate or nitrite accelerators to the alcohol achieves a level of auto-ignition sufficient to operate in diesel engines. Unfortunately, these fuel compositions, devoid of any petroleum derived products, are notably deficient in lubricity or lubricating properties with the result that engine wear from use of these fuels in internal combustion reciprocating the diesel engines is a serious problem. Of particular concern are wear problems associated with the fuel injector mechanisms used in such engines. Wear problems have also been encountered in diesel engines operating on light diesel fuel oils as disclosed in U.S. Pat. No. 4,002,437.

Fatty acid dimers and the amine salts thereof have been used in hydrocarbon fluid compositions for many years. Their principle function appears to have been as hydrocarbon fluid rust or corrosion inhibitors. Typical background patents showing such use are U.S. Pat. Nos. 3,696,048, 2,822,330, 2,631,979, 2,632,695, and 3,017,354. Esters of phosphorus acid have been used for many years in lubricating oil compositions. They have found use, for example, as wear inhibitors and as modifying reactants for corrosion inhibitors. Such uses are disclosed in U.S. Pat. Nos. 3,694,357 and 2,315,072, respectively.

Summary of the Invention

It has now been found that the addition of certain dimerized unsaturated fatty acids in combination with an ester of a phosphorus acid to compression ignition fuels adapted for use in diesel engines which comprise (1) a monohydroxy alkanol having from 1 to 5 carbon atoms and (2) an ignition accelerator can significantly improve the wear characteristics of said fuels.

DESCRIPTION OF THE PREFERRED EMBODIMENTS

A preferred embodiment of the present invention is an anti-wear compression ignition fuel for use in diesel engines comprising (1) a monohydroxy alkanol having from 1 to 5 carbon atoms, (2) an ignition accelerator, and (3) a wear inhibiting amount of a dimerized unsaturated fatty acid and an ester of a phosphorus acid.

A further embodiment of the present invention is a method for inhibiting engine wear in an internal combustion reciprocating diesel engine operating on a compression ignition fuel comprising (1) a monohydoxy alkanol having from 1 to 5 carbon atoms, (2) an ignition accelerator, and (3) a wear inhibiting amount of a dimerized unsaturated fatty acid and an ester of a phosphorus acid, said method comprising (a) supplying to the fuel induction system of said engine said compression ignition fuel, (b) inducting air into the combustion chambers of said engine, (c) compressing said air, (d) injecting said compression ignition fuel into said combustion chambers containing said compressed air, (e) igniting said compressed mixture, and (f) exhausting the resultant combustion products resulting in reduced engine wear in said engine.

A still further embodiment of the present invention is a method for preparing a compression ignition fuel adapted for use in diesel engines having anti-wear properties which comprises blending (1) a wear inhibiting amount of a dimerized unsaturated fatty acid and an ester of a phosphorus acid with (2) a monohydroxy alkanol having from 1 to 5 carbon atoms, and (3) an ignition accelerator.

Monohydroxy alcohols which can be used in the present invention include those containing from 1 to 5 carbon atoms. Preferred alcohols are saturated aliphatic monohydric alcohols having from 1 to 5 carbon atoms. Methanol, ethanol, propanol, n-butanol, isobutanol, amyl alcohol and isoamyl alcohol are preferred alcohols for use in the present invention. Of these, ethanol is the most preferred.

The dimerized unsaturated fatty acid component of the fuel composition of the present invention is preferably a dimer of a comparatively long chain fatty acid, e.g. containing from 8 to 30 carbon atoms, and may be pure, or substantially pure, dimer. Alternatively, and preferably, the material sold commercially and known as "dimer acid" may be used. This latter material is prepared by dimerizing unsaturated fatty acid and consists of a mixture of monomer, dimer and trimer of the acid. A particularly preferred dimer acid is the dimer of linoleic acid.

The ignition accelerator component of the anti-wear compression ignition fuel composition of the present invention is an organic nitrate. Preferred organic nitrates are substituted or unsubstituted alkyl or cycloalkyl nitrates having up to about 10 carbon atoms, preferably from 2 to 10 carbon atoms. The alkyl group may be either linear or branched. Specific examples of nitrate compounds suitable for use in the present invention include, but are not limited to the following:

methyl nitrate
ethyl nitrate
n-propyl nitrate
isopropyl nitrate
allyl nitrate
n-butyl nitrate
isobutyl nitrate
sec-butyl nitrate
tert-butyl nitrate
n-amyl nitrate
isoamyl nitrate
2-amyl nitrate
3-amyl nitrate
tert-amyl nitrate
n-hexyl nitrate
2-ethylhexyl nitrate
n-heptyl nitrate
sec-heptyl nitrate
n-octyl nitrate
sec-octyl nitrate
n-nonyl nitrate
n-decyl nitrate
n-dodecyl nitrate
cyclopentylnitrate
cyclohexylnitrate
methylcyclohexyl nitrate
isopropylcyclohexyl nitrate and the esters of alkoxy substituted aliphatic alcohols, such as 1-methoxypropyl-2-nitrate, 1-ethoxypropyl-2-nitrate 1-isopropoxy-butyl nitrate, 1-ethoxybutyl nitrate and the like. Preferred alkyl nitrates are ethyl nitrate, propyl nitrate, amyl nitrates and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates would be n-hexyl nitrate, 2-ethylhexyl nitrate, 4-methyl-n-pentyl nitrate and the like. Preparation of the nitrate esters may be accomplished by any of the commonly used methods; such as, for example, esterification of the appropriate alcohol, or reaction of a suitable alkyl halide with silver nitrate.

Other conventional ignition accelerators may also be used in the present invention, such as hydrogen peroxide, benzoyl peroxide, etc. Further certain inorganic and organic chlorides and bromides, such as, for example, aluminum chloride, ethyl chloride or bromide may find use in the present invention as primers when used in combination with the alkyl nitrate accelerators of the present invention.

The phosphorus acid ester wear inhibiting components found to be particularly effective for use in the anti-wear compression ignition fuel compositions of the present invention are the esters of phosphorus acid, such as phenyl, benzl, creysl, or xylyl phosphates and phosphites. Similarly, higher homologous aryl, alkaryl, or aralkyl phosphates and phosphites may be used. Such esters can be obtained according to known methods which involve reacting an alcohol with phosphorus pentoxide or $POCl_3$ to form the phosphates and by reacting the appropriate alcohol with phosphorus trichloride to form the phosphites. Specific examples of phosphorus acid esters effective as wear inhibiting agents in the anti-wear fuel compositions of the present invention include tricresyl phosphate, tricresyl phosphite, phenyl dicresyl phosphate, and the like. A preferred phosphorus acid ester is diamyl phenyl hydrogen phosphate. Other phosphorus acid esters suitable for use in the present compositions are the organic dialkyl phosphonates having hydrogen bonded to phosphorus. Representative of these compounds are: di-n-butyl phosphonate, diisopropyl phosphonate, dioctyl phosphonate, bis(2-ethylhexyl) phosphonate, di-sec-butyl phosphonate, diisobutyl phosphonate, di-tert-butyl phosphonate, bis(1,3-dimethylbutyl) phosphonate, diamyl phosphonate, bis(2-chloro 1-methylethyl) phosphonate, ditolyl phosphonate, diethyl phosphonate, bis(β-chloroisopropyl phosphonate, O,S-dimethyl thiophosphonate, diphenyl phosphonate, ditolyl thiophosphonate, (tolyl) (isooctenyl) phosphonate, ditolyl phosphonate, dimethyl phosphonate, and methyl tolyl phosphonate.

The amount of dimerized unsaturated fatty acid used in the compression ignition fuel compositions of the present invention should be enough to provide the desired wear protection when used in combination with the appropriate amount of phosphorus acid ester components of the present invention. This concentration is conveniently expressed in terms of weight percent of dimerized unsaturated fatty acid based on the total weight of the compression ignition fuel composition. A preferred range is from about 0.001 to about 2.0 weight percent dimerized unsaturated fatty acid. A more preferred range is from about 0.05 to about 1.5 weight percent dimerized unsaturated fatty acid. A most preferred range is from about 0.1 to about 1.0 weight percent dimerized unsaturated fatty acid.

The amount of alkyl nitrate or nitrite ignition accelerator used should be an amount which will achieve the level of auto-ignition sufficient to allow the operation of diesel engines on the fuel composition of the present invention. A useful range is from about 0.1 weight percent to about 5.0 weight percent based on the total compression ignition fuel composition. Preferred amounts are between 0.5 weight percent and 3.0 weight percent.

The amount of phosphorus acid ester wear inhibiting agent used in the compression ignition fuel compositions of the present invention should be enough to provide the desired wear protection when used in combination with the appropriate amount of the dimerized unsaturated fatty acid component of the present invention. A useful range is from about 0.001 weight percent to about 2.0 weight percent based on the total weight of the compression ignition fuel composition. Preferred amounts are between about 0.05 weight percent and 1.0 weight percent.

Other additives may be used in formulating the compression ignition fuel compositions of the present inventions. These compounds include demulsifying agents, corrosion inhibitors, antioxidants, dyes, process oil, kerosene and the like, provided they do not adversely effect the anti-wear effectiveness of the dimerized unsaturated fatty acid additives.

Conventional blending equipment and techniques may be used in preparing the fuel composition of the present invention. In general, a homogeneous blend of the foregoing active components is achieved by merely blending the dimerized unsaturated fatty acid and the phosphorus acid ester components of the present invention with the monohydroxy alkanol and ignition accelerator components in a determined proportion sufficient to reduce the wear tendencies of the fuel. This is normally carried out at ambient temperature. The following examples illustrate the preparation of some typical fuel compositions of the present invention.

EXAMPLE I

To a blending vessel is added 1000 parts of 190 proof ethanol, 50 parts n-propyl nitrate and 1 part of a blend of 45 weight percent of the dimer acid derived from linoleic acid, 40 weight percent kerosene, 10 weight percent process oil and 5 weight percent of diamyl phenyl hydrogen phosphate. The mixture is stirred at room temperature until homogenous forming a fuel composition useful for reducing and/or inhibiting the amount of engine wear in internal combustion reciprocating diesel engines operating on said fuel composition.

EXAMPLE II

To a blending vessel is added 1000 parts of 190 proof ethanol, 5 parts n-propyl nitrate and 5 parts of a blend of 45 weight percent of the dimer acid derived from linoleic acid, 40 weight percent kerosene, 10 weight percent process oil and 5 weight percent of diamyl phenyl hydrogen phosphate. The mixture is stirred at room temperature until homogenous forming a fuel composition useful for reducing and/or inhibiting the amount of engine wear in internal combustion reciprocating diesel engines operating on said fuel composition.

The amounts of each ingredient in the foregoing compositions can be varied within the limits aforediscussed to provide the optimum degree of each property.

The lubricity or wear properties of the fuel compositions were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameters of the scars on the three lower balls are measured by means of a low power microscope, and the average diameter measured in two directions on each of the three lower balls is taken as a measure of the anti-wear characteristics of the fuel. A larger scar diameter means more wear. The balls were immersed in base fuel containing the test additives. Applied load was 5 kg and rotation was at 1,800 rpm for 30 minutes at ambient temperature. Tests were conducted both with base fuel* alone and base fuel containing the test additives.

Results are as follows:

| Additive | Scar Diameter (mm) Run 1 | Run 2 | Run 3 |
|---|---|---|---|
| None (baseline) | 0.89 | 0.90 | |
| A(1) | 0.46 | | |
| B(2) | 0.21 | 0.32 | 0.29 |
| C(3) | 0.52 | | |
| D(4) | 0.62 | | |
| E(5) | 0.54 | | |
| F(6) | 0.56 | | |

*Base fuel was 190 proof ethanol.

*Base fuel was 190 proof ethanol.
(1) 1.0 weight percent of a blend of 45 weight percent dimer acid derived from linoleic acid, 40 weight percent kerosene, 10 weight percent process oil and 5 weight percent diamyl phenyl hydrogen phosphate.
(2) 0.1 weight percent of a blend of 45 weight percent dimer acid derived from linoleic acid, 40 weight percent kerosene, 10 weight percent process oil and 5 weight percent diamyl phenyl hydrogen phosphate.
(3) 5.0 weight percent n-propyl nitrate plus 0.5 weight percent of a blend of 45 weight percent dimer acid derived from linoleic acid, 40 weight percent kerosene, 10 weight percent process oil and 5.0 weight percent diamyl phenyl hydrogen phosphate.
(4) 5.0 weight percent n-propyl nitrate plus 0.5 weight percent of a blend of 45 weight percent dimer acid derived from linoleic acid, 40 weight percent kerosene, 10 weight percent process oil and 5.0 weight percent diamyl phenyl hydrogen phosphate.
(5) 5.0 weight percent n-hexyl nitrate plus 0.1 weight percent of a blend of 45 weight percent dimer acid derived from linoleic acid, 40 weight percent kerosene, 10 weight percent process oil and 5.0 weight percent diamyl phenyl hydrogen phosphate.
(6) 5.0 weight percent 2-ethylhexyl nitrate plus 0.1 weight percent of a blend of 45 weight percent dimer acid derived from linoleic acid, 40 weight percent kerosene, 10 weight percent process oil and 5.0 weight percent diamyl phenyl hydrogen phosphate.

The test fuel without any additive (190 proof ethanol) gave scar diameters of 0.89 mm and 0.90 mm. respectively in two separate tests. A mixture of 45 weight percent dimer acid of linoleic acid, 40 weight percent kerosene, 10 weight percent process oil and 5.0 weight percent diamyl phenyl hydrogen phosphate at a concentration of 1.0 weight percent significantly reduced the wear index to 0.46 mm. The same mixture at a concentration of 0.1 weight percent reduced the wear index to 0.21 mm, 0.32 mm and 0.29 mm, respectively. The same mixture at the same concentration added to the base fuel containing 5.0 weight percent n-propyl nitrate as an ignition accelerator reduced the wear index to 0.52 mm. It appears that the presence of the nitrate accelerator in the fuel composition reduces to some extent the anit-wear properties of the dimer acid-phosphorus acid ester containing mixture. When the concentration of the dimer acid-phosphorus acid ester mixture was increased to 0.5 weight percent and added to the base fuel containing 5.0 weight percent n-propyl nitrate, the wear index was reduced to 0.62 mm. The addition of 0.1 weight percent of the dimer acid-phosphorus acid ester mixture to the base fuel containing as ignition accelerators 5.0 weight percent n-hexyl nitrate and 5.0 weight percent 2-ethylhexyl nitrate reduced the wear index to 0.54 mm and 0.56 mm, respectively.

The dimerized unsaturated fatty acid and phosphorus acid ester components of the present invention are also effective anti-wear agents when used in fuel compositions for use in diesel engines which comprise mixtures of monohydroxy alkanols having from 1 to 5 carbon atoms and fuel oil boiling above the gasoline boiling range.

I claim:

1. As a new composition of matter, an anti-wear compression ignition fuel for use in diesel engines comprising (1) a monohydroxy alkanol having from 1 to 5 carbon atoms, (2) an ignition accelerator, and (3) a wear inhibiting amount of a dimerized unsaturated fatty acid and an ester of a phosphorus acid.

2. The composition of claim 1 wherein said monohydroxy alkanol is ethanol.

3. The composition of claim 1 wherein said dimerized unsaturated fatty acid is the dimer acid derived from linoleic acid.

4. The composition of claim 1 wherein said ester of phosphorus acid is selected from phenyl, benzyl, cresyl, and xylyl phosphates and phosphites.

5. The composition of claim 4 wherein said ester of phosphorus acid is diamyl phenyl hydrogen phosphate.

6. The composition of claim 1 containing as an ignition accelerator a substituted or unsubstituted alkyl or cycloalkyl nitrate having up to about 10 carbon atoms.

7. The composition of claim 6 wherein said ignition accelerator is selected from methyl nitrate, ethyl nitrate, propyl nitrate, amyl nitrates, hexyl nitrates or a mixture of primary amyl nitrates and primary hexyl nitrates.

8. The composition of claim 7 wherein said ignition accelerator is ethyl nitrate.

9. The composition of claim 7 wherein said monohydroxy alkanol is ethanol.

10. The composition of claim 9 wherein said dimerized unsaturated fatty acid is the dimer derived from linoleic acid.

11. The composition of claim 10 wherein said ester of phosphorus acid is diamyl phenyl hydrogen phosphate.

12. The composition of claim 11 containing from about 0.001 weight percent to about 2.0 weight percent dimer acid derived from linoleic acid, from about 0.1 weight percent to about 5.0 weight percent ignition accelerator and from about 0.001 weight percent to about 2.0 weight percent diamyl phenyl hydrogen phosphate based on the total weight of said composition.

13. A method for inhibiting engine wear in an internal combustion reciprocating diesel engine operating on a compression ignition fuel comprising (1) a monohydroxy alkanol having from 1 to 5 carbon atoms, (2) an ignition accelerator, and (3) a wear inhibiting amount of a dimerized unsaturated fatty acid and an ester of a phosphorus acid said method comprising (a) supplying to the fuel induction system of said engine said compression ignition fuel, (b) inducting air into the combustion chambers of said engine, (c) compressing said air, (d) injecting said compression ignition fuel into said combustion chambers containing said compressed air (e) igniting said compressed mixture, and (f) exhausting the resultant combustion products resulting in reduced engine wear in said engine.

14. The method of claim 13 wherein said monohydroxy alkanol is ethanol.

15. The method of claim 13 wherein said dimerized unsaturated fatty acid is the dimer acid derived from linoleic acid.

16. The method of claim 13 wherein said fuel composition contains an ester of phosphorus acid selected from phenyl, benzyl, cresyl, and xylyl phosphates and phosphites.

17. The method of claim 16 wherein said ester of phosphorus acid is diamyl phenyl hydrogen phosphate.

18. The method of claim 13 wherein said fuel composition contains as an ignition accelerator a substituted or unsubstituted alkyl or cycloalkyl nitrate having up to about 10 carbon atoms.

19. The method of claim 18 wherein said ignition accelerator is selected from methyl nitrate, ethyl nitrate, propyl nitrate, amyl nitrates, hexyl nitrates or a mixture of primary amyl nitrates and primary hexyl nitrates.

20. The method of claim 19 wherein said ignition accelerator is ethyl nitrate.

21. The method of claim 19 wherein said monohydroxy alkanol is ethanol.

22. The method of claim 21 wherein said dimerized unsaturated fatty acid is the dimer acid derived from linoleic acid.

23. The method of claim 22 wherein said phosphorus acid ester is diamyl phenyl hydrogen phosphate.

24. The method of claim 23 wherein said ignition accelerator is present in an amount of from about 0.1 weight percent to about 5.0 weight percent, said dimer acid derived from linoleic acid is present in an amount of from about 0.001 weight percent to about 2.0 weight percent and said diamyl phenyl hydrogen phosphate is present in an amount of from about 0.001 weight percent to about 2.0 weight percent based on the total weight of the composition.

25. A method for preparing a compression ignition fuel adapted for use in diesel engines having anti-wear properties which comprises blending (1) a wear inhibiting amount of a dimerized unsaturated fatty acid and an ester of a phosphorus acid, with (2) a monohydroxy alkanol having from 1 to 5 carbon atoms, and (3) an ignition accelerator.

26. The method of claim 25 wherein said monohydroxy alkanol is ethanol.

27. The method of claim 25 wherein said dimerized unsaturated fatty acid is the dimer acid derived from linoleic acid.

28. A method of claim 25 wherein said ester of phosphorus acid is phenyl, benzyl, creysl, and xylyl phosphates and phosphites.

29. The method of claim 28 wherein ester of phosphorus acid is diamyl phenyl hydrogen phosphate.

30. The method of claim 25 wherein said ignition accelerator is a substituted or unsubstituted alkyl or cycloalkyl nitrate having to about 10 carbon atoms.

31. The method of claim 30 wherein said ignition accelerator is selected from methyl nitrate, ethyl nitrate, propyl nitrate, amyl nitrates, hexyl nitrates or a mixture of primary amyl nitrates and primary hexyl nitrates.

32. The method of claim 31 wherein said ignition accelerator is ethyl nitrate.

33. The method of claim 31 wherein said monohydroxy is ethanol.

34. The method of claim 33 wherein said dimerized unsaturated fatty acid is the dimer derived from linoleic acid.

35. The method of claim 34 wherein said ester of phosphorus acid diamyl phenyl hydrogen phosphate.

36. The method of claim 35 wherein said ignition accelerator is present in an amount from about 0.1 weight percent to about 5.0 weight percent, said dimer acid derived from linoleic acid is present in an amount of from about 0.001 weight percent to about 2.0 weight percent and said diamyl phenyl hydrogen phosphate is present in an amount of from about 0.001 weight percent to about 2.0 weight percent based on the total weight of the composition.

37. The composition of claim 1 wherein said ester of phosphorous acid is selected from aryl, alkaryl and aralkyl phosphates and phosphites.

38. The method of claim 13 wherein said fuel composition contains an ester of phosphorous acid selected from aryl, alkaryl and aralkyl phosphates and phosphites.

39. A method of claim 25 wherein said ester of phosphorous acid is selected from aryl, alkaryl and aralkyl phosphates and phosphites.

* * * * *